US005228491A

United States Patent [19]

Rude et al.

[11] Patent Number: 5,228,491

[45] Date of Patent: Jul. 20, 1993

[54] MONOCONTROL VENETIAN BLIND

[75] Inventors: Edward T. Rude, Columbia, Md.; Martin Waine, Greenwich, Conn.

[73] Assignee: General Clutch Corporation, Stamford, Conn.

[21] Appl. No.: 862,843

[22] Filed: Apr. 3, 1992

[51] Int. Cl.[5] ..... E06B 9/30

[52] U.S. Cl. ..... 160/171; 160/168.1; 160/176.1

[58] Field of Search ..... 160/168.1, 176.1, 178.1, 160/170, 171

[56] References Cited

U.S. PATENT DOCUMENTS

| | | | |
|---|---|---|---|
| 2,250,106 | 7/1941 | Lorentzen . | |
| 2,737,235 | 3/1956 | Hediger . | |
| 2,758,644 | 8/1956 | Virlouvet . | |
| 2,765,030 | 10/1956 | Bechtler | 160/170 |
| 3,352,349 | 11/1967 | Hennequin . | |
| 4,200,135 | 4/1980 | Hennequin . | |
| 4,623,012 | 11/1986 | Rude et al. . | |
| 4,697,630 | 10/1987 | Rude . | |
| 5,123,472 | 6/1992 | Nagashima et al. | 160/176.1 |

*Primary Examiner*—Blair M. Johnson

*Attorney, Agent, or Firm*—Gottlieb, Rackman & Reisman

[57] ABSTRACT

Headrail hardware to lift and tilt a Venetian blind is provided. A single control operates both the lift and the tilt function. A multiturn band brake tilter is used with each ladder cord in a way that reduces the frictional forces encountered in lifting or lowering the blind. One end of each of the ladder cords is attached to an arm of its tilter. The tilters are disposed directly about the rotating drive rod with no intermediate parts, and are supported by cradles that mount in the headrail rather than by the drive rod as in prior art blinds. The drive rod rotates the tilters and the lifting mechanism until the tilters contact stops built into each of the cradles. Further rotation keeps the blind fully tilted while lifting or lowering of the blind continues. In the preferred embodiment, the lift cords are attached to the drive rod, which traverses to accumulate the cords in a single layer as the rod is rotated to lift the blind. The rotation of the rod within the tilters greatly reduces the lateral force needed to traverse the rod. An innovative bearing support is provided so that the weight of the blind is transferred from the tilter directly to the cradle, further reducing the frictional drag on the traversing rod.

14 Claims, 7 Drawing Sheets

FIG. 1
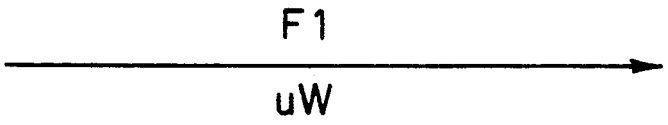
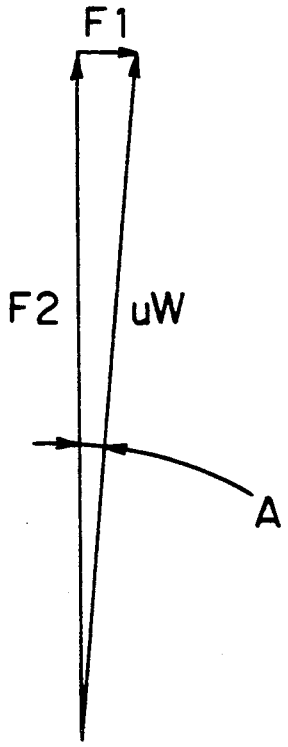
FIG. 2

MONOCONTROL VENETIAN BLIND

BACKGROUND TO THE INVENTION AND PRIOR ART

Our invention relates to Venetian Blinds, and, more particularly to monocontrol Venetian Blinds that use the same operating control both for controlling the tilting of the slats, and for raising and lowering the blind.

The headrail mechanism of a Venetian blind must provide for two operations; first, lifting and lowering the blind, and second, controllably tilting the slats to open or close the blind or set the slats at any desired angle. The ideal monocontrol headrail mechanism would require low operation effort, even when lifting heavy and long blinds. It would provide for accumulating the lift cords or tapes within a relatively small headrail. It would have a tilt mechanism capable of providing good closure. And finally, it would contain a minimum of parts and be easy to assemble and require a minimum of adjustment.

The prior art does contain a number of designs for monocontrol Venetian blinds. Some of them do not tilt sufficiently to provide good closure. Many of them use a large number of complex parts and are difficult to adjust.

The prior art reveals two general methods for accumulating lift cords or tapes within a Venetian blind headrail. One method is to wind the lift cords or tapes onto spools. This method suffers two disadvantages. One disadvantage is that the cords or tapes do not wind evenly onto their respective spools, and very slight differences in diameter produce easily noticeable unevenness in the blind as it is raised. The other disadvantage is that the mechanical advantage of the lift mechanism decreases as the diameter of the accumulated cord or tape increases on the spools. This progressive decrease in mechanical advantage occurs as the lift cords support more of the blind's weight, causing a large increase in the effort required to further lift the blind. The mechanical advantage decreases just when it should increase.

The other, and preferred method is to accumulate the cords onto a shaft that moves laterally, or traverses, so that the lift cords wind in a single layer onto the shaft. This insures even winding of each of the lift cords, and it maintains a constant mechanical advantage so that the lifting effort increases only in proportion to the weight supported by the lift cords. Several methods have been used to produce the traversing of the rod. A rack and gear arrangement has been used. U.S. Pat. No. 1,343,527 reveals a lead screw and nut to accomplish the traversing. Another method, one that is free of any gears or leadscrews, is revealed in U.S. Pat. No. 4,625,012 in which the lift cords, acting on cam features of their supporting cradles, produce the lateral forces to traverse the rod. Although, this method is presently used in a variety of blinds that lift from the bottom, it was not believed that the method could work with Venetian blinds because it was expected that the weight of the blinds hanging on the tilters would add so much frictional drag that the rod would not traverse properly.

The headrail mechanism must also provide for tilting the slats of a Venetian blind. In a monocontrol blind that employs a traversing rod on which to accumulate the lift cords, the tilt mechanism must rotate in either direction along with the traversing rod until the position for full closure is reached. Thereafter, the tilt mechanism must slip, maintaining its position, while the blind is raised or lowered. In a traversing rod monocontrol Venetial blind, the drive shaft for the tilt mechanism is the traversing rod. The ladder cords are attached to the tilter mechanism. Generally, in a monocontrol blind, there will be one tilter mechanism for each ladder cord in the blind. The best tilting results if the ladder cords are attached to the tilter at a separation equal to the width of the slats. Furthermore, a line between these attachment points should pass through the centerline of the traversing rod. This will keep the tilter at the same angle as the slats. If this geometric relationship is not maintained, then it will be necessary for the tilt mechanism to be capable of lifting the blind if full closure is to be achieved.

In a Venetian blind having separate lift and tilt mechanisms, there is no difficulty in providing a tilt mechanism capable of lifting the weight of the entire blind. However, in a traversing rod monocontrol blind, the traversing rod must drive both the tilt and the lift mechanisms. When the fully tilted position is reached, the tilt mechanism must partially disengage and slip, providing, thereafter, sufficient torque to maintain full tilt as the rod continues to rotate for lifting or lowering the blind. Whatever force is needed to maintain full tilt is added to the effort required to lift the blind. This force will be minimum if, (a) the tilter geometry is as described above, and (b) if the tilter mechanism is capable of adjusting its grip on the traversing rod to provide only that amount of torque needed to maintain full tilt. Furthermore, the smaller the separation of the two sides of the ladder cords at full tilt, the better the closure will be. This last requirement will be best satisfied if the tilters are mounted directly on the traversing rod. Any intermediate part between the tilters and the rod will increase the separation of the ladder cords at full tilt. U.S. Pat. No. 4,697,630 reveals a tilter mechanism which has good gripping torque between extremes of tilt while partially releasing its grip when full tilt is reached. This tilter is made in the form of a multiturn helical band clutch which grips the traversing rod during tilting. When the position for full tilt has been reached, the leading end of the tilter contacts a stop which prevents further movement of the tilter and partially releases the grip of the tilter on the rod, thereby limiting the frictional drag of the tilters on the rod to just that amount of torque required to maintain the fully tilted condition of the blind. The rod can continue to rotate, winding or unwinding the lift cords to raise or lower the blind according to the direction in which the rod is being rotated.

U.S. Pat. Nos. 2,737,235, 2,758,644, and 3,352,349, describe prior art monocontrol Venetian blinds that employ a variety of traversing rod lift mechanisms. In order to achieve traversing in each of the prior art blinds it is necessary to overcome all of the frictional force due to the weight of the blind acting on the traversing rod. The grip of the tilt mechanism on the traversing rod must be sufficient to ensure complete closure. And, of course, both the tilt force and the drag on the rod must be overcome to cause the rod to traverse. These frictional forces are large enough to make these blinds very difficult to operate. It is, therefore, not surprising that Venetial blinds using this type of mechanism have never been popular.

SUMMARY OF THE INVENTION

The desirable characteristics of the helical band tilter of U.S. Pat. No. 4,697,630 can be combined with the traversing rod system according to U.S. Pat. No. 4,623,012 to produce a Venetian blind that has monocontrol operation and accumulates the lift cords within the headrail. This combination has been tried and found to be unsatisfactory because the tilters impose so much frictional drag on the traversing rod that it does not traverse reliably. Our invention consists in providing a novel bearing arrangement that removes much of this frictional drag. In the preferred embodiment, the band clutch of U.S. Pat. No. 4,697,630 is modified so that the tilter is supported directly by the cradle rather than by the traversing rod. This greatly reduces the frictional forces on the traversing rod which improves the reliability of operation. The blind has good closure, and yet it is easy to raise and lower. It has a small number of parts and is easy to assemble and adjust. The inventive combination has the advantages of both the tilting mechanism and the lifting mechanism without the problem of sliding the rod against large frictional forces found in prior art blinds.

The use of the helical wrap band clutch tilter is crucial because it alone, among the various known methods for driving the tilters in a monocontrol blind, is capable of providing large friction when needed during tilting, while controlling the frictional forces between the tilters and the traversing rod to the minimum amount needed to maintain full tilt. Other methods that employ a predetermined frictional connection between the rod and the tilter must, due to the variability of frictional forces, provide an excess of frictional force to ensure good closure of the blind. This extra force adds undesirably to the effort of operating the blind. U.S. Pat. No. 3,352,349 reveals a monocontrol Venetian blind using a traversing rod and a tilter which frictionally grips the traversing rod. Lift cord carrier 15 is "arranged in a slightly clamping manner" on operating shaft 2. But experience has shown that the tilter must grip the operating shaft tightly during tilting to provide good closure of the blind, and the friction from this tight grip will require the exertion of large forces by the traversing mechanism to cause the shaft to slide.

In a fully extended Venetian blind, the ladder cords support the entire weight. As the blind is raised, weight is transferred to the lift cords. When the blind is fully raised, virtually the entire weight of the slat pack and the bottom rail are supported by the lift cords. The ladder cords are attached to the tilters, so whatever supports the tilters must also support the weight of the extended portion of the blind. The normal forces between the tilters and their supports, and the resulting friction caused thereby, can make traversing difficult when the blind nears full extension. At that time the tilters are supporting most of the weight, producing maximum friction, and the tension in the lift cords, which is needed to produce the traversing motion, is at its minimum value.

It is surprising that it is possible to produce sufficient tilt drive without burdening the traversing mechanism with so much friction that traversing fails. The reason that it is possible can be understood as follows. The force needed to produce relative motion between two frictionally coupled objects is greater if only that force is active than it is if another force is also causing motion, even if that motion is in a different direction. For instance, referring to FIG. 1, the force, F1, needed to slide an object of weight W across a horizontal surface equals uW, where u is the coefficient of friction between the object and the surface. But if the object is moving under the action of two perpendicular forces, F1 and F2, then it is the vector sum of F1 and F2 that equals uW, and as seen in FIG. 2, in which A is the angle between F2 and the actual direction of motion. In this situation, both F1 and F2 are smaller than uW and, if the angle A is small, F1 will be far smaller than uW.

In our case, F2 corresponds to the force causing the rod to rotate, which forces it to slip within the tilter, and F1 corresponds to the force required to cause the rod to traverse. In a typical embodiment of our invention, we have use a rod of 0.375" diameter, and lift cords of about 0.040" diameter. Since the rod rotates one complete revolution while traversing only a distance equal to the thickness of the cord, the surface motion in the rotational direction is about 30 times the motion in the traversing direction, making the angle A quite small, somewhat less than 2 degrees. In this case, the force, F2, which causes the rotational motion does most of the work against friction, and F1 is only about 3% of what it would have to be to cause the traversing motion in the absence of F2. In a blind having an intermediate piece between the tilter and the drum, the full amount of work must be done at both interfaces, between the tilter and the drum, and between the drum and the rod. As the entire amount of work must be provided by the operator of the blind, this considerably increases the effort required to operate the blind.

It has been found necessary, in very long blinds that use the tilter of U.S. Pat. No. 4,697,630, to add weight to the bottom rail to insure that the traversing rod returns fully to its starting position. In the preferred embodiment of our invention great improvement is achieved by modifying the tilter and cradle so that the tilter is supported directly by a bearing surface on the cradle rather than by the traversing rod. The improved performance comes from the reduction in normal forces between the rod and the tilters. This greatly reduces the force needed to traverse the rod. In the earlier system, the force required to cause traversing increased just as the force available to cause traversing was decreasing. In this, preferred embodiment while the force available to cause traversing still decreases as the blind is lowered, the frictional force impeding the traversing motion of the rod remains constant and small.

Accordingly, it is an object of our invention to provide a monocontrol lift and tilt mechanism for a Venetian blind that requires minimal effort to operate and which maintains constant mechanical advantage during lifting.

It is a another object of our invention to provide a monocontrol lift and tilt mechanism for a Venetian blind with low operating effort in lifting heavy and long blinds.

It is a further object of our invention to provide a monocontrol lift and tilt mechanism for Venetian blinds which can lift long blinds in a relatively small headrail.

Another object of our invention is to provide a monocontrol lift and tilt mechanism for Venetian blinds which can exert enough torque to ensure good closure.

A further object of our invention is to provide a monocontrol lift and tilt mechanism for Venetian blinds which permits the close alignment of the ladder cords at the positions of full tilt.

Still another object of our invention is to provide a monocontrol lift and tilt mechanism for Venetian blinds in which the entire torque required for tilting does not have to be reacted during raising of the blind.

Yet a further object of our invention is to provide a monocontrol lift and tilt mechanism for Venetian blinds having a minimum of component parts and which can be easily assembled and adjusted for proper operation.

BRIEF DESCRIPTION OF THE DRAWINGS

Further object, features and advantages of our invention will become apparent upon consideration of the following detailed description in conjunction with the drawings, in which:

FIG. 1 is a vector diagram of the force F1, equal to uW in this situation, needed to cause traversing in the absence of other motion;

FIG. 2 is a vector diagram of the forces F1 and F2 and their resultant uW, where F1, now much smaller than uW, is the force needed to cause traversing in the presence of other motion at the same interface;

DETAILED DESCRIPTION OF THE DRAWINGS

Figure 3:
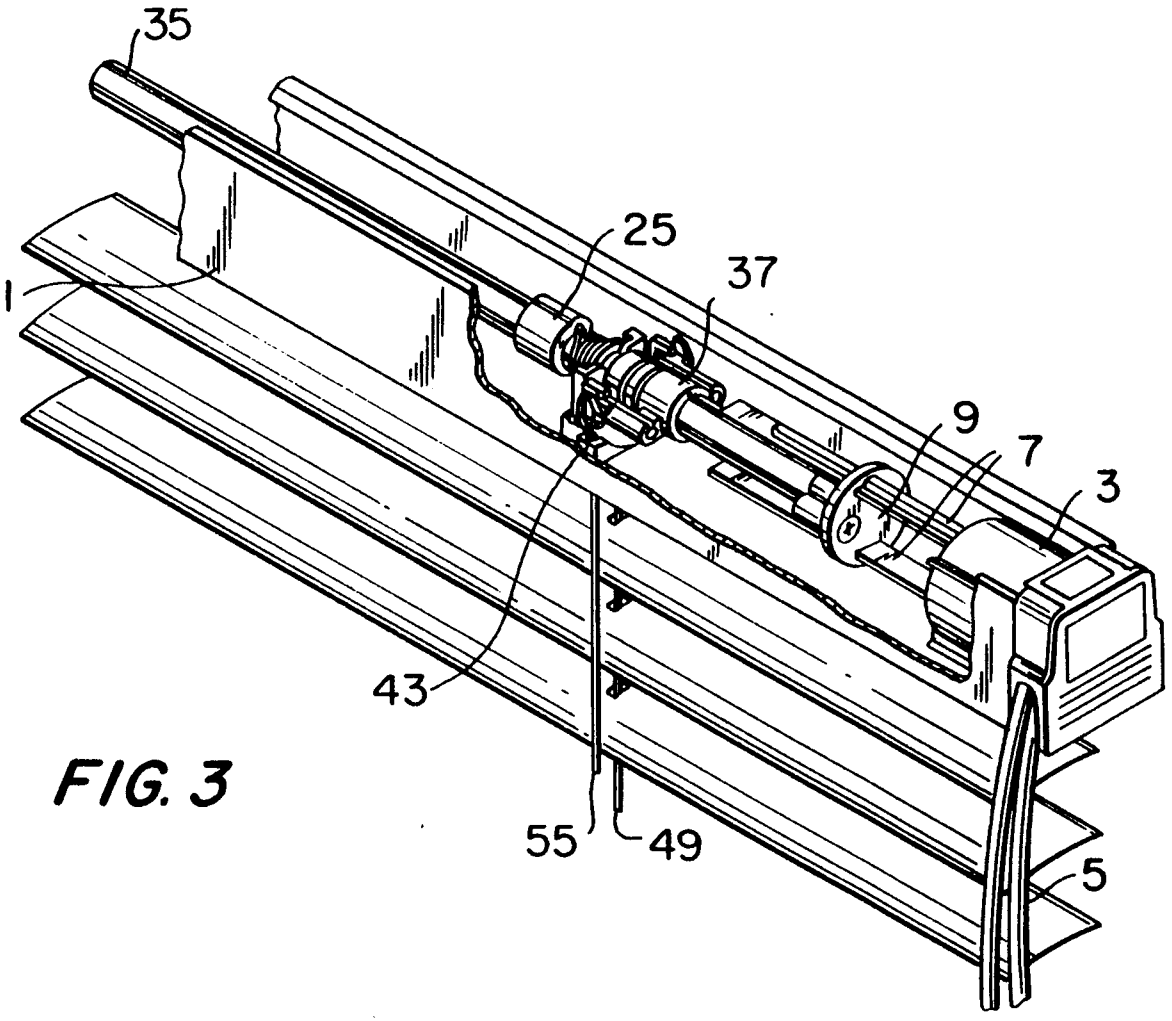
FIG. 3 is an isometric view of a Venetian blind headrail of our invention that has been cut away to reveal the parts within.

The general organization of the lift system within the headrail can be seen in FIG. 3. Headrail 1 can be of any convenient cross-sectional shape having sufficient interior space to accommodate the hardware. Holding mechanism 3, which could be any of a wide variety of devices, is preferably mounted at an end of headrail 1, although other placements are possible. Some appropriate operating means is needed for operating holding mechanism 3. In this case cord loop 5 is shown, although any of a number of other combinations of holding mechanism and operating means might be used instead. Splines 7 are attached to the output of holding mechanism 3. Splines 7 together with disk 9 which is attached to traversing rod 35 form an axially slidable torque carrying connection between holding mechanism 3 and traversing rod 35. The particular spline and disk arrangement shown here for making the connecting to the holding mechanism is intended only as an example, and other means for accomplishing the connection may be used without deviating from the intent and purpose of our invention.

The remaining parts within the headrail are associated with the attachment, control, and operation of lift cord 49 and ladder cord 55. One such set would, ordinarily, be provided for each set of lift and ladder cords. The identification of parts, forces, and descriptions of operation are made for one set of these lift and tilt components, and are intended to apply to the other sets as well. In some blinds, a partial set of components may be used in one or more locations. For instance, blinds often have three ladder cords but only two lift cords. This is done when two lift cords are sufficient to lift the blind, but a central ladder cord is still needed for proper support of the slats. In such cases, the operation of the blind remains the same as it relates to the components in the incomplete set.

Figure 4:
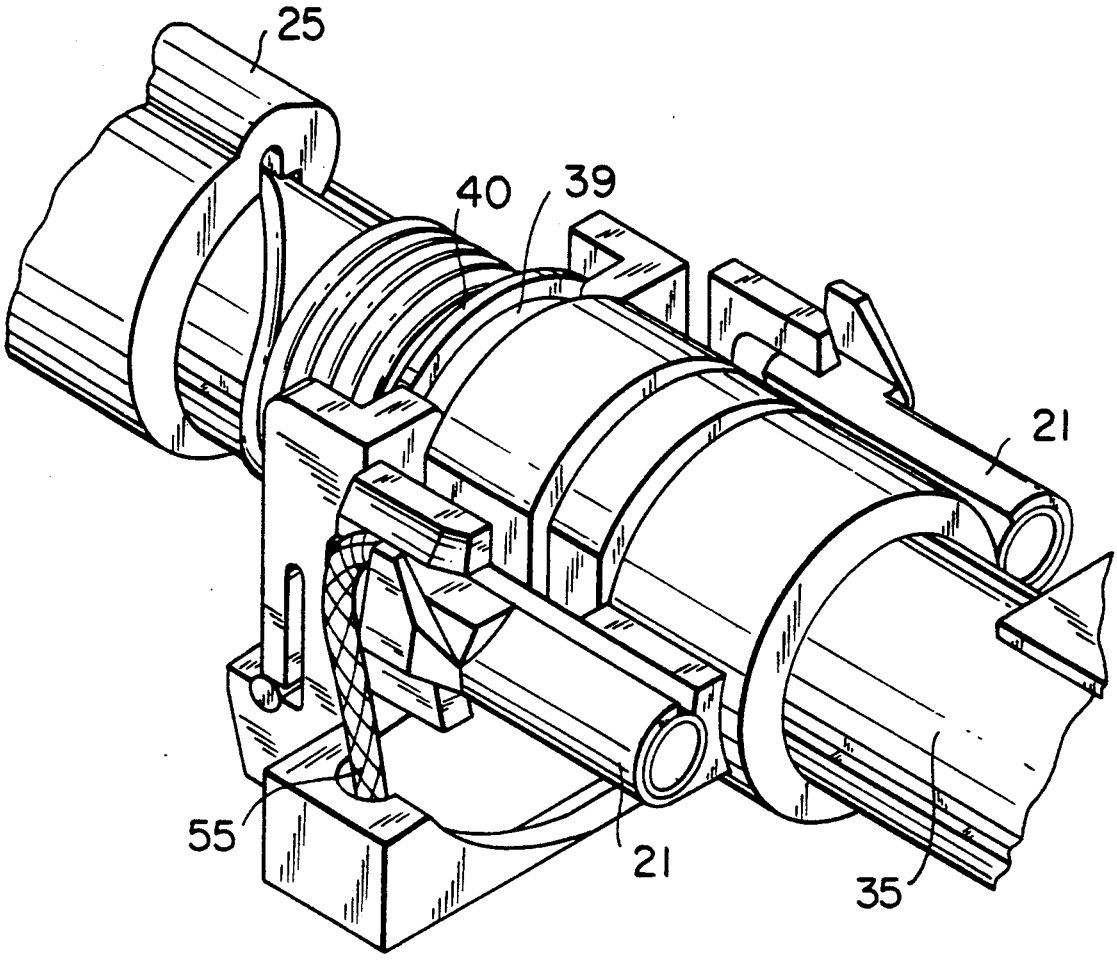
FIG. 4 is an enlarged view of a portion of the mechanism of FIG. 3 to better show the detail of the lifting and tilting parts and the inventive feature of the preferred embodiment of our invention.

Cradle 43 and tilter 37 are arranged generally in accordance with the principles of U.S. Pat. No. 4,697,630. Each of the sides of ladder cord 55 is attached to one of the two arms 21 of tilter 37 as best seen in FIG. 4. Lift cord 49 is arranged generally in accordance with the principles of U.S. Pat. No. 4,623,012, entering the headrail through a hole in the bottom of the rail, passing over roller 23, seen in FIG. 5, and terminating in its attachment to rod 35 by means of clip 25 or by any other suitable means.

Figure 5:
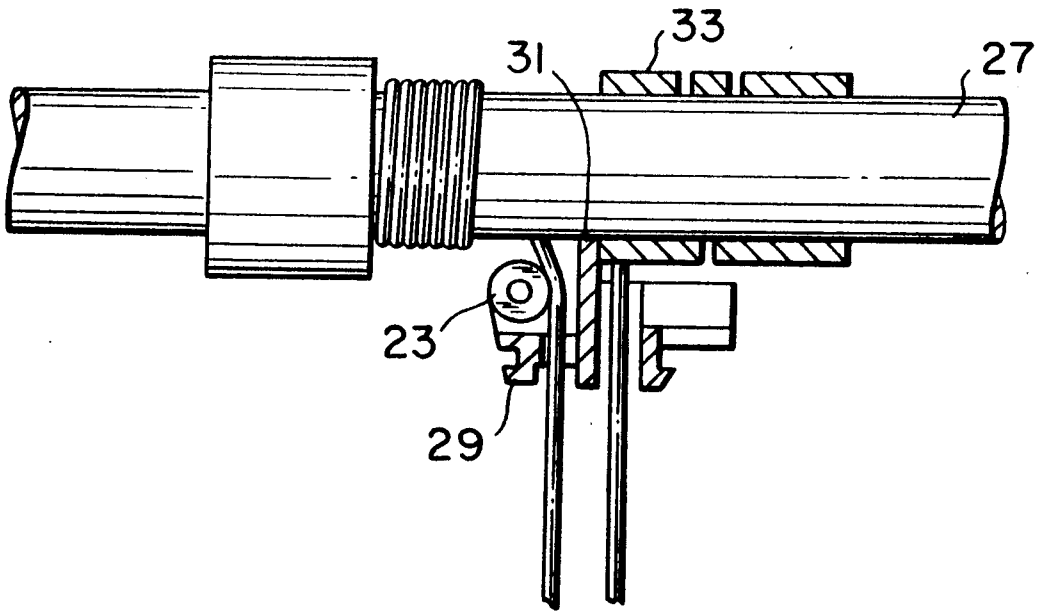
FIG. 5 is an enlarged side elevation and partial cross-sectional view according to the prior art of a lift tilt mechanism at one of the lift points, showing a tilter, the traversing rod and a cradle.

FIG. 5 shows the prior art combination of a traversing rod lift system according to the principles of U.S. Pat. No. 4,623,012 with a helical band tilter according to the principles of U.S. Pat. No. 4,697,630. Traversing rod 27 is supported directly by cradle 29 whose bearing surface 31 is shaped to accept rod 27. Tilter 33 is disposed about and entirely supported by rod 27.

Figure 6:
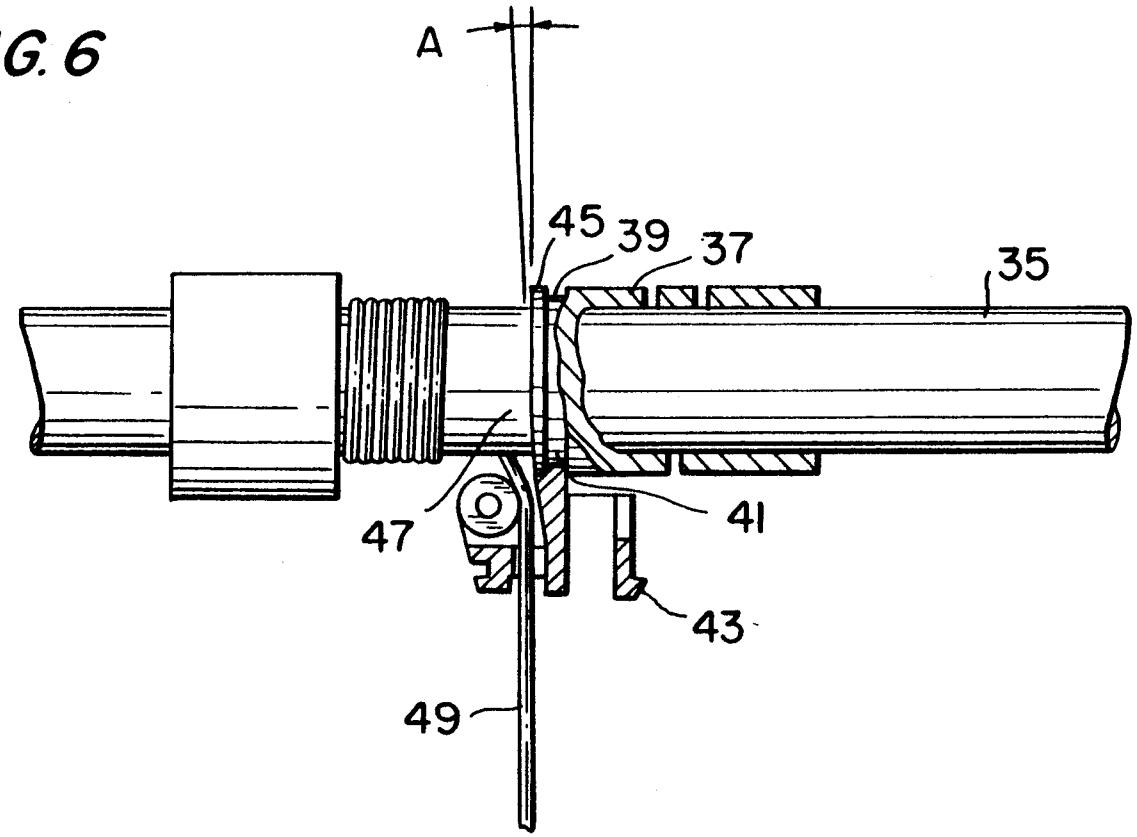
FIG. 6 is a similar view of the same components, in this case, showing the tilter supported by the cradle according to the principles of our invention.

FIG. 6 shows the tilt and lift components of our invention with the slats in a horizontal position. In this view, arms 21, shown in FIG. 4, but omitted from FIG. 6 for clarity, would lie in the horizontal plane passing through the center of rod 35. Tilter 37 is wrapped about rod 35 as in the earlier embodiment, but in this case the tilter has bearing 39 which is supported at bearing surface 41 on cradle 43. Flange 45 at the end of tilter 37 forms a retaining barrier to prevent axial movement of tilter 37 in relation to cradle 43 along rod 35. The outer surface of flange 45 is angled to form camming surface 47 according to the principles of U.S. Pat. No. 4,623,012. The angle is shown in FIG. 6 as angle A. The desirable size of angle A depends upon the ratio of the diameter of lift cord 49 to the diameter of the rod. Sufficient movement must be produced by the camming action to provide space for the incoming cord so that it will not override the previous turns. When the blind is fully lowered and most of the weight is hanging from the blind's several ladder cords, then very little of the blind's weight is supported at the surface between rod 35 and tilter 37. Instead, most of the weight is supported at bearing surface 41 between cradle 43 and tilter 37. This reduction of frictional force between the tilter and the traversing rod allows the rod to be moved much more easily. With this improved bearing support for tilter 37, much less tension in lift cord 49 is needed to insure the complete return of traversing rod 35 to its starting position as the blind is fully lowered.

Figure 7:
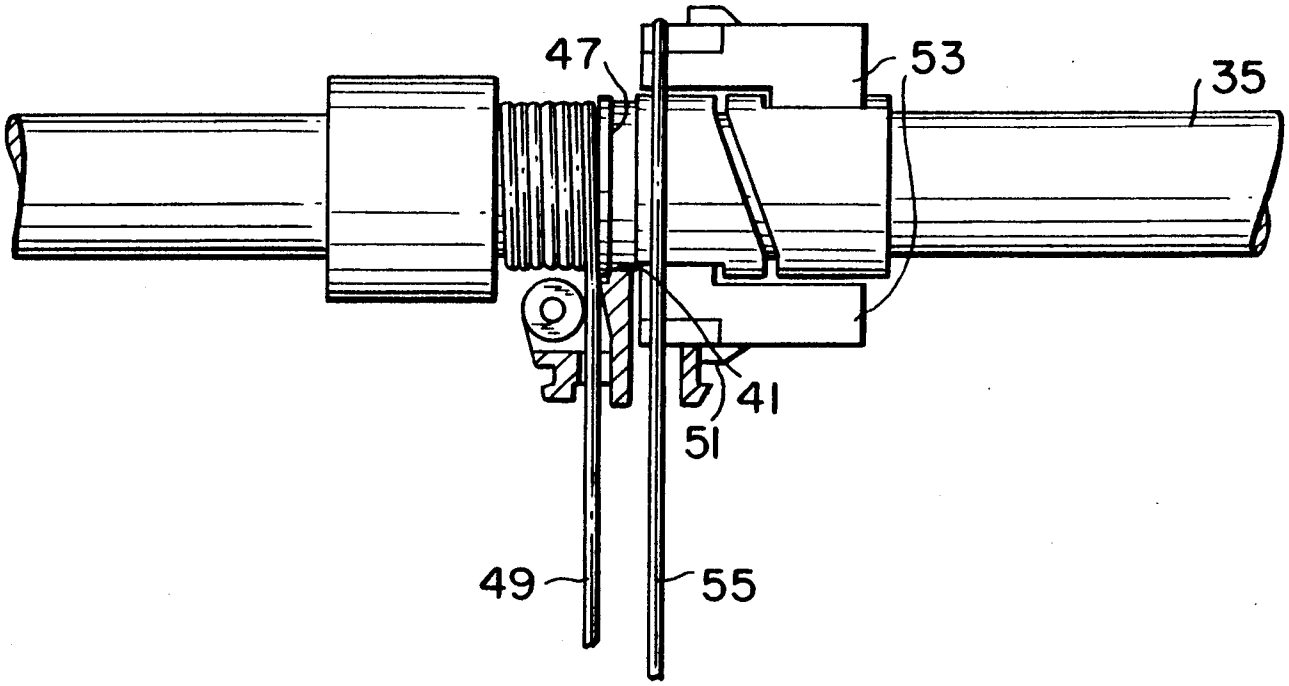
FIG. 7 is a view of the same components as in FIG. 6 but shown during lifting of the blind and, thus, with the tilter rotated 90 degrees.

FIG. 7 shows the same components as shown in FIG. 6 but during lifting of the blind. Lift cord 49, as it is wound onto rod 35, contacts camming surface 47, forcing rod 35 to traverse to the left, away from the camming surface. Tilter 37 is fully rotated to the limit permitted by stop 51 which loosens the grip of tilter 37 on rod 35, retaining only sufficient grip to maintain its orientation. In this position, arms 53 are roughly vertical, and the ladder cords, of which only the near one, ladder cord 55 is visible, are in the fully tilted position.

The mechanism of U.S. Pat. No. 4,523,012 has no tilter. The camming surface is formed as a part of the cradle. In our invention, the cord comes into contact with the tilter flange. Therefore it is necessary to incorporate the camming surface onto this flange. One of the features of our inventive blind is that it can be raised by rotating the rod in either direction. This requires that the camming surface be on the right side when the blind is being lifted by counterclockwise rotation of the rod, and on the left for the opposite rotation. When the blind is being raised, the tilter rotates 90 degrees in the direction of the rod's rotation. This orients camming surface 47 properly for that winding direction of the lift cord. The camming action takes place in about a one hundred and twenty degree arc between the point where the cord first contacts the shaft and the top of the shaft. When tilter 37 is horizontal, as seen in FIG. 6, camming surface 47 occupies the lower portion of flange 45. As the tilter rotates 90 degrees one way or the other, the camming surface rotates into the required orientation.

Figure 8:
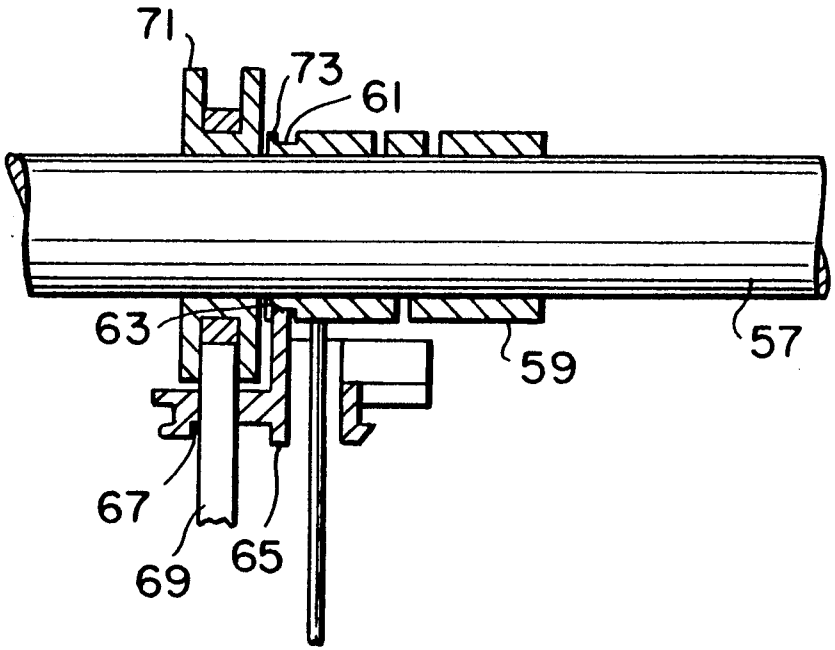
FIG. 8 is an enlarged side elevation and partial cross-sectional view of another embodiment of our invention that employs a spool with either cord or tape for lifting the blind.

In another embodiment of our invention, tilters are also supported directly by the cradles rather than by the operating rod which, in this case, does not traverse, but simply rotates. In this type of monocontrol blind, lifting is accomplished by winding the tape or cord onto spools. Although there is no traversing rod in this type of blind, the reduction of operating friction remains a serious issue to which great amounts of effort have been directed, even to the extent that production tooling has been replaced several times to achieve small improvements in the operating "feel" of blinds mad with this hardware. FIG. 8 show the lifting and tilting components for this embodiment that correspond to the components of the preferred embodiment shown in FIGS. 5 and 6. Rod 57 has tilter 59 disposed thereabout. Tilter 59 has bearing groove 61 which rotates on and is supported by bearing surface 63 of cradle 65. Cradle 65 is similar to cradle 37 of the preferred embodiment except that in place of a roller to guide a lift cord, it has a slot 67 to guide cord or tape 69 onto spool 71. Since there is no traversing of the rod in this case, spool 71 is firmly attached to rod 57 so as to rotate with it. As before, tilter 59 must rotate with rod 57 until reaching its stop. Thereafter, it must remain in position, maintaining full tilt, while rod 57 continues to rotate within it to raise or lower the blind. The control of friction is important in this case to insure that there be sufficient grip of the tilter on rod 57 to produce full tilt. But any additional frictional drag between these parts will simply add to the effort of operating the blind. A significant savings in operating effort is obtained by shifting the support load from rod 57 to bearing surface 63 of cradle 65. Because in this embodiment the rod does not traverse, there is no requirement for a camming surface, and flange 73 of tilter 59 can have an exterior surface normal to the axis of rod 57.

It will thus be seen that the objects set forth above among those made apparent from the preceding description, are efficiently attained and, since certain changes may be made in the construction of the inventive spring clutch without departing from the spirit and scope of the invention, it is intended that all matter contained in the above description or shown in the accompanying drawings shall be interpreted as illustrative and not in a limiting sense.

It is also to be understod that the following claims are intended to cover all of the generic and specific features of the invention herein described and all statements of the scope of the invention which, as a matter of language, might be said to fall therebetween.

What is claimed:

1. A combination monocontrol tilt and lifting system for venetian blinds with ladder cords comprising:

a traversing rod rotatable along the axis thereof in two directions;

at least one multiturn helical tilting member rotatably disposed about said rod and attached to the ladder cords of said blinds;

means for at least partially loosening the tilting member with respect to the rod at positions corresponding to full tilt from either direction of rotation;

at least one lift cord attached to said rod and responsive to rod rotation for wrapping around and winding from said rod;

means for applying a lateral force on said traversing rod in a first direction as said lift cord is wrapped around said rod; and means for supporting said traversing rod comprising at least one cradle having a surface adapted to accept said rod and located substantially where said at least one lift cord is attached to the rod, said cradle further having a surface for supporting said tilting member in order to reduce frictional drag on the rod.

2. The system of claim 1, wherein said loosening means comprises means for restraining rotatable movement of said tilting member at said full tilt positions.

3. The system of claim 2, wherein said restraining means comprises at least one stop for loosening the grip of said tilting member on said rod at said full tilt positions.

4. The system of claim 1, wherein said at least one tilting member includes a central portion configured for gripping the rod and two arms for receiving the ends of said ladder cords.

5. The system of claim 1, wherein said at least one tilting member is flexible.

6. The system of claim 1, wherein the inside diameter of the at least one tilting member is substantially equal to the outside diameter of the rod such that the weight of the venetian blinds causes tightening of the at least one tilting member about the rod.

7. The system of claim 1, wherein the at least one tilting member is mounted directly on the rod in the absence of any intermediate member.

8. The system of claim 1, wherein said cradle includes an opening through which said ladder cords pass.

9. The system of claim 1, wherein said first applying means includes a camming surface against which said lift cord bears to enable said rod to lateral move in said first lateral direction.

10. The system of claim 9, wherein said camming surface is configured such that rotation of said traversing rod for wrapping said lift cord thereabout causes said rod to move in a lateral direction.

11. The system of claim 10, wherein said camming surface is configured such that rotation of said rod wraps the lift cord on said rod in a single layer.

12. The system of claim 1, wherein said at least one tilting member includes a protruding flange for maintaining axial alignment of said helical member with respect to said cradle member.

13. The system of claim 12, wherein said flange includes a camming surface against which said lift cord bears to enable said rod to traverse.

14. The system of claim 13, wherein said camming surface of said flange is disposed at an angle which depends upon the dimensions of the rod and the lift cord.

* * * * *